US009534515B2

(12) United States Patent
Raecklebe

(10) Patent No.: US 9,534,515 B2
(45) Date of Patent: Jan. 3, 2017

(54) CAMSHAFT PHASER

(71) Applicant: SCHAEFFLER TECHNOLOGIES GMBH & CO. KG, Herzogenaurach (DE)

(72) Inventor: Steffen Raecklebe, Obermichelbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/786,883

(22) PCT Filed: Feb. 11, 2014

(86) PCT No.: PCT/DE2014/200053
§ 371 (c)(1),
(2) Date: Oct. 23, 2015

(87) PCT Pub. No.: WO2014/173398
PCT Pub. Date: Oct. 30, 2014

(65) Prior Publication Data

US 2016/0069227 A1 Mar. 10, 2016

(30) Foreign Application Priority Data

Apr. 26, 2013 (DE) ..... 10 2013 207 617

(51) Int. Cl.
*F01L 1/34* (2006.01)
*F01L 1/344* (2006.01)

(52) U.S. Cl.
CPC .... *F01L 1/3442* (2013.01); *F01L 2001/34426* (2013.01); *F01L 2001/34446* (2013.01); *F01L 2001/34466* (2013.01)

(58) Field of Classification Search
CPC ..... F01L 1/3442; F01L 2001/34426; F01L 2001/34446; F01L 2001/34466
(Continued)

(56) References Cited

U.S. PATENT DOCUMENTS 7,506,622 B2 3/2009 Takahashi et al.
8,534,242 B2 * 9/2013 Busse ..... F01L 1/3442 123/90.12
(Continued)

FOREIGN PATENT DOCUMENTS

DE 102007000695 3/2008
DE 102007028187 12/2008
(Continued)

*Primary Examiner* — Ching Chang
(74) *Attorney, Agent, or Firm* — Davidson, Davidson & Kappel, LLC

(57) ABSTRACT

A camshaft phaser having a vane-type phaser having a central-position locking device having locking pins lockable in a locking slot stationary with respect to the stator and locking in the locking slot from different directions. A locking pin has a blocking portion and a flow-through pressure medium conduit, by which a fluid connection between two working chambers of different directions of action can be established or blocked in the different positions of the first locking pin. The working chambers-of the different directions of actions are capable of being short-circuited by a switching device. At least one pressure medium conduit fluidically connectable to the pressure medium circuit by the flow-through pressure medium conduit of the locking pin has a check valve therein which allows the pressure medium to flow into one of the working chambers whose volume is increased during a rotation of the rotor from either of the advance or retard stop positions toward the central locking position, while at the same time preventing backflow from the same working chamber.

5 Claims, 3 Drawing Sheets

Figure 1:
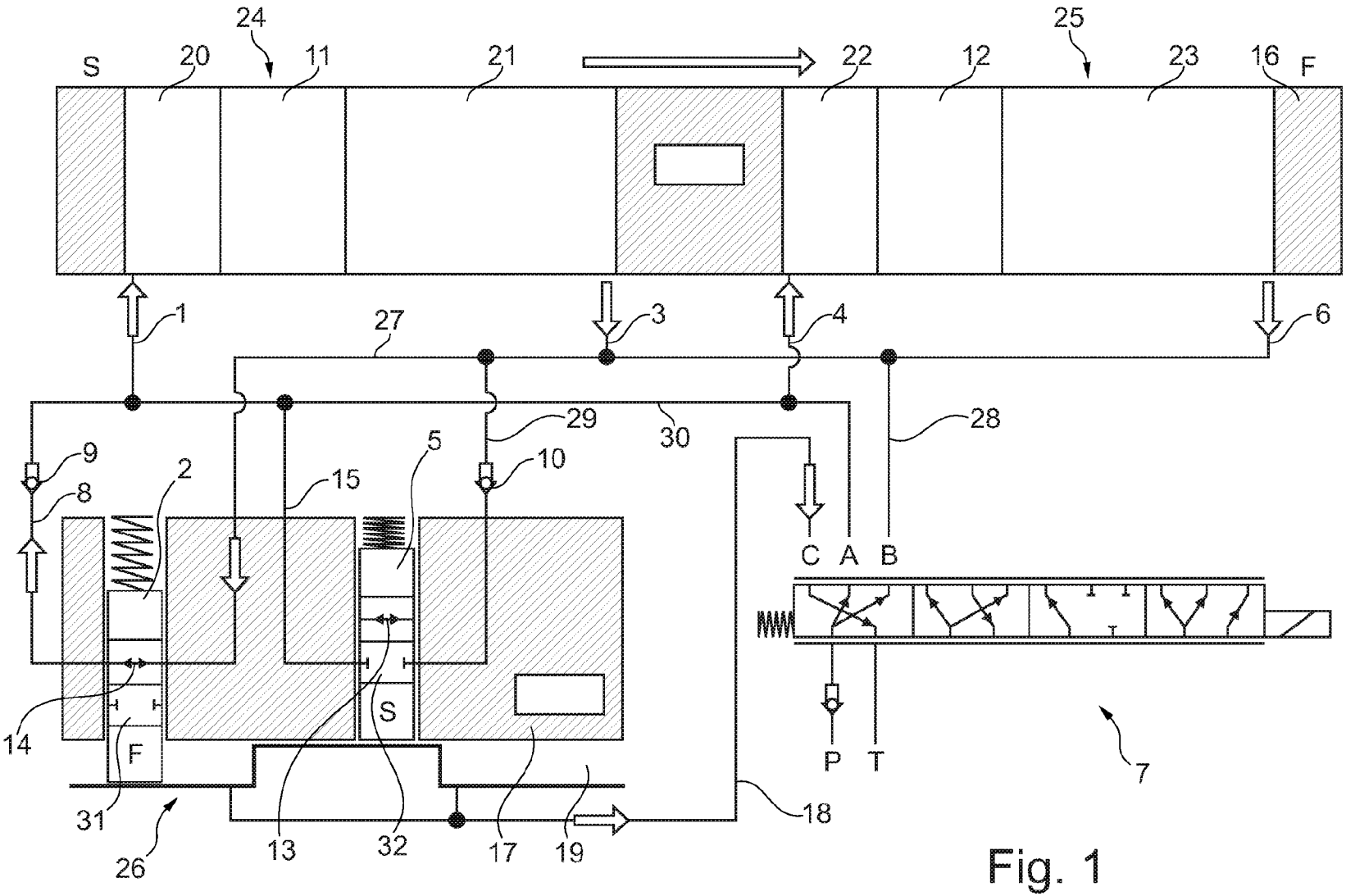

(58) Field of Classification Search
USPC ..... 123/90.15, 90.17
See application file for complete search history.

(56) References Cited

U.S. PATENT DOCUMENTS

| | | | |
|---|---|---|---|
| 9,080,471 | B2 | 7/2015 | Pluta et al. |
| 2005/0205032 | A1 | 9/2005 | Lehmann |
| 2011/0067657 | A1 | 3/2011 | Strauss |
| 2011/0088645 | A1 | 4/2011 | Yamaguchi et al. |

FOREIGN PATENT DOCUMENTS

| | | |
|---|---|---|
| DE | 102008011915 | 9/2009 |
| DE | 102008011916 | 9/2009 |
| DE | 112011103646 T5 | 8/2013 |
| EP | 2161418 | 3/2010 |
| EP | 2508723 | 10/2012 |
| WO | WO2004/033860 | 4/2004 |

* cited by examiner

CAMSHAFT PHASER

The present invention relates to a camshaft phaser.

BACKGROUND

Camshaft phasers are generally used in valve actuation systems of internal combustion engines to vary the valve opening and closing times, thereby making it possible to improve the fuel consumption figures of the internal combustion engine and the general operating characteristics.

One camshaft phaser design that has proven suitable in practice features a vane-type phaser having a stator and a rotor defining an annular space which is divided by projections and vanes into a plurality of working chambers. The working chambers can be selectively pressurized with a pressure medium which is fed by a pressure medium pump in a pressure medium circuit from a pressure medium reservoir into the working chambers on one side of the vanes of the rotor, and returned to the pressure medium reservoir from the working chambers on the respective other side of the vanes. The working chambers whose volume is thereby increased have a direction of action opposite to that of the working chambers whose volume is decreased. The direction of action accordingly means that pressurizing one of the groups of working chambers with pressure medium causes the rotor to rotate in a corresponding clockwise or counterclockwise direction relative to the stator. The flow of pressure medium, and thus the adjusting movement of the camshaft phaser, is controlled, for example, by a central valve having a complex system of flow passages and control edges and a valve body displaceable within the central valve to close or clear the passage openings as a function of its position.

One problem of such camshaft phasers is that, during a starting phase, they are not yet completely filled with pressure medium, or may even have run empty, so that the rotor may perform uncontrolled movements relative to the stator as a result of the alternating torques exerted by the camshaft. Such uncontrolled movements may lead to increased wear and unwanted noise generation. To avoid this problem, it is known to provide a locking device between the rotor and the stator. When the internal combustion engine is stopped, this locking device locks the rotor relative to the stator in an angular position that is favorable for the starting procedure. In exceptional cases, for example when the engine stalls, it may happen that the locking device does not lock the rotor as intended, and that the camshaft phaser must be operated with the rotor unlocked during the following starting phase. However, since some internal combustion engines have very poor starting performance when the rotor is not locked in the central position, the rotor must then be automatically rotated to the central locking position and locked during the starting phase.

Such automatic rotation and locking of the rotor relative to stator is known, for example, from DE 10 2008 011915 A1 and DE 10 2005 011 916 A1. Both of the locking devices described therein include a plurality of spring-loaded locking pins, which successively lock in locking slots provided in the sealing cover or the stator during a rotation of the rotor. Before the central locking position is reached, the respective locking pins permit rotation of the rotor in a direction toward the central locking position, but inhibit rotation of the rotor in the opposite direction. After the internal combustion engine has warmed up and/or after the camshaft phaser has been completely filled with pressure medium, the locking pins are urged out of the locking slots under the action of the pressure medium, so that the rotor can then be rotated as intended to adjust the angular position of the camshaft relative to the stator.

SUMMARY OF THE INVENTION

A disadvantage of this approach is that the locking of the rotor can only be accomplished with a plurality of successively locking locking pins, which results in higher costs. Further, the locking operation requires that the locking pins reliably lock successively. If one of the locking pins does not lock, the locking operation may be interrupted because the rotor is consequently not unidirectionally locked in the intermediate position and may rotate back.

It is an object of the present invention to provide a camshaft phaser having reliable and inexpensive means for locking the rotor in a central position.

The present invention provides at least one locking pin be provided with a blocking portion and a flow-through pressure medium conduit, by which a fluid connection between two working chambers of different directions of action can be established or blocked in the different positions of the first locking pin, and that the working chambers of the different directions of actions be capable of being short-circuited by a switching device, and that at least one pressure medium conduit which is fluidically connectable to the pressure medium circuit by the flow-through pressure medium conduit of the locking pin have a check valve therein which allows the pressure medium to flow into one of the working chambers whose volume is increased during a rotation of the rotor from either of the advance or retard stop positions toward the central locking position, while at the same time preventing backflow from the same working chamber.

The solution proposed herein allows the rotor to rotate in one direction relative to the stator utilizing the alternating torques (Camshaft Torque Actuated, CTA) acting on the camshaft during the starting phase of the internal combustion engine, while rotation in the respective other direction is blocked by the respective check valve. In this way, a kind a freewheel device is implemented, which enables the rotor to automatically rotate from an advance or retard stop position toward the central locking position until it is finally locked in the central locking position. In order to prevent the movement of the rotor from being impeded at the same time by the pressure medium in the other working chambers, these are short-circuited by the switching device that is provided. The check valve is deliberately disposed in a pressure medium conduit leading to the working chamber, which avoids the need to modify the rotor or the stator in the region of the pressure chambers.

It is also proposed to provide a flow-through pressure medium conduit in each of the two locking pins, and to provide two check valves in different pressure medium conduits which are connectable to the pressure medium circuit via the flow-through pressure medium conduits of the locking pins, the check valves being oriented to allow the pressure medium to flow into working chambers of different directions of action and to prevent backflow from the same working chambers.

Further, it is proposed that, in a first position, the locking pin(s) allow the pressure medium to flow to the check valve(s) via the flow-through pressure medium conduit and that, in a second position, the locking pin(s) prevent such flow via blocking portions, and that the locking pin(s) be spring-loaded in a direction toward the first position. In accordance with the proposed solution, the locking pins are automatically urged into the first position when the internal combustion engine is stopped, provided they are located relative to the locking slot in a suitable position which makes this possible. Thus, during the starting phase of the internal combustion engine, the pressure medium can immediately flow into the respective working chamber utilizing the alternating camshaft torques, and suitably rotate the rotor so as to return it to the central locking position.

Still further, it is proposed that the switching device for short-circuiting the working chambers take the form of a multi-way control valve controlling the inflow and outflow of the pressure medium from or into a pressure medium reservoir. The multi-way control valve, also referred to as central valve, is a proven component for controlling the adjusting movement of the rotor. In accordance with the proposed solution, this multi-way control valve is additionally used to control the short-circuiting between the working chambers, the multi-way control valve also controlling the locking and releasing movements of the locking pins and the flow of pressure medium into and out of the working chambers.

It is also proposed that the rotor have one or more partial ring-shaped or ring-shaped pressure medium conduit(s) provided therein into which open at least some of the pressure medium conduits leading to the working chambers. The solution proposed herein makes it possible to achieve a readily producible routing configuration of the pressure medium conduits, which in particular allows a plurality of working chambers of one direction of action to be short-circuited to a group of working chambers of a different direction of action via a single switching device.

BRIEF DESCRIPTION OF THE INVENTION

Figure 2:
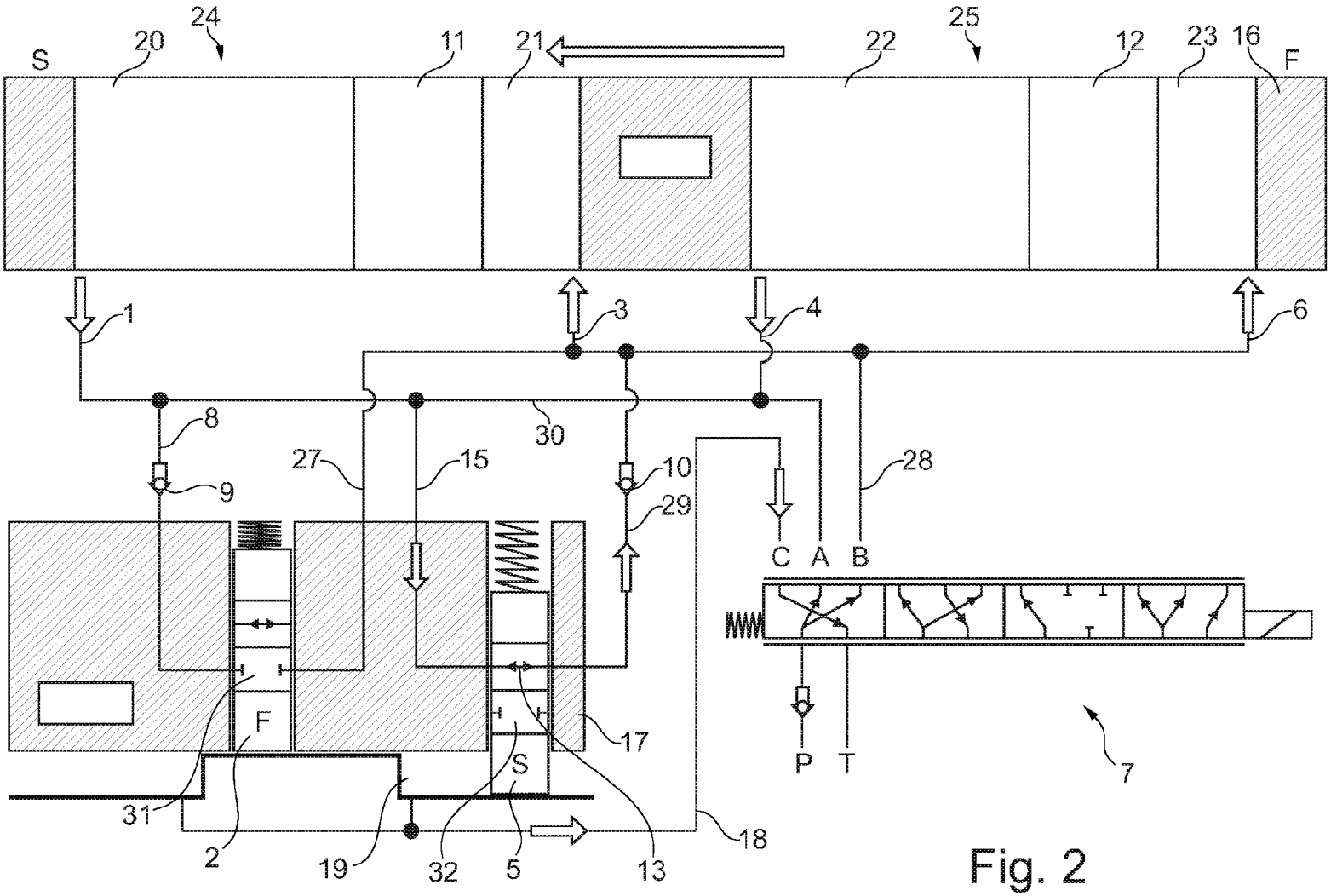
Figure 3:
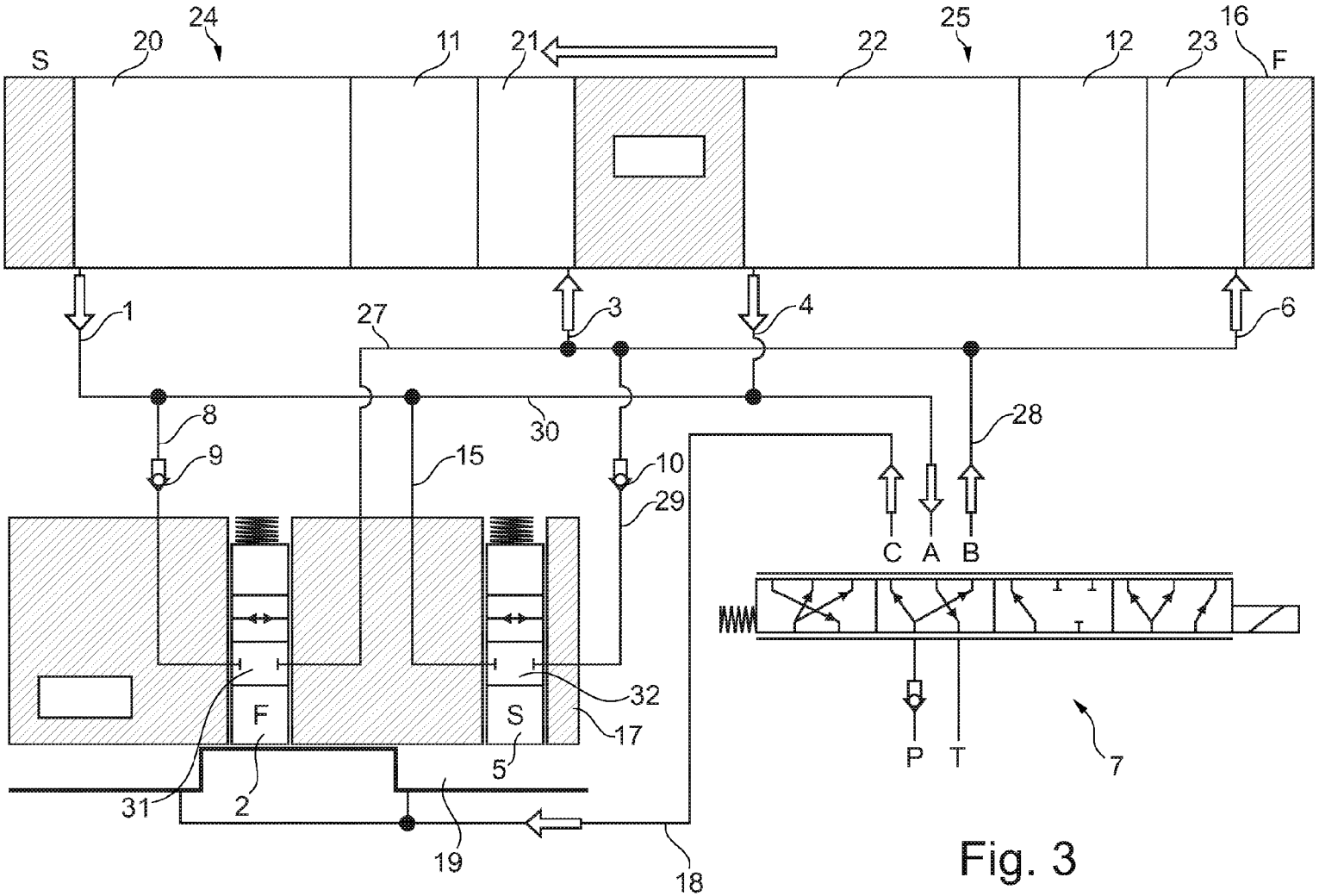

The present invention will now be described in more detail by way of an exemplary embodiment. In the drawings, FIG. 1 is a schematic view showing an inventive camshaft phaser and a circuit diagram of a pressure medium circuit in a condition during an adjusting movement of the rotor in a direction from a retard position toward the central locking position;

FIG. 2 is a schematic view showing an inventive camshaft phaser and a circuit diagram of a pressure medium circuit in a condition during an adjusting movement of the rotor in a direction from an advance position toward the central locking position; and FIG. 3 is a schematic view showing an inventive camshaft phaser and a circuit diagram of a pressure medium circuit during the adjusting movement and during normal operation.

DETAILED DESCRIPTION

In FIGS. 1 through 3, there is shown a camshaft phaser whose basic design is known in the art and which has, as a basic component, a schematically illustrated vane-type phaser including a stator 16 capable of being driven by a crankshaft and a rotor 17 which is non-rotatably connectable to a camshaft and has a plurality of vanes 11 and 12 extending radially outwardly therefrom. The upper view shows the vane-type phaser in a developed representation. The lower left view schematically shows a portion of rotor 17 including a central-position locking device 26, and the lower right view schematically shows a switching device in the form of a multi-way control valve 7 for controlling the pressure medium flow. Multi-way control valve 7 has an A-port, a B-port and a C-port having pressure medium conduits 18, 30 and 28 fluidically connected thereto. Further, multi-way control valve 7 is fluidically connected to a pressure medium reservoir T and a pressure medium pump P which, upon actuation of the camshaft phaser, feeds the pressure medium in a pressure medium circuit back from pressure medium reservoir T after it has been returned thereto.

Also shown is a pressure medium circuit having a plurality of pressure medium conduits 1, 3, 4, 6, 8, 13, 14, 15, 18, 27, 28, 29 and 30, which are selectively fluidically connectable via multi-way control valve 7 to pressure medium pump P or pressure medium reservoir T.

Stator 16 has a plurality of stator lobes dividing an annular space between stator 16 and rotor 17 into pressure chambers 24 and 25. Pressure chambers 24 and 25 are in turn divided by vanes 11 and 12 of rotor 17 into working chambers 20, 21, 22 and 23 into which open pressure medium conduits 1, 3, 4 and 6. Central-position locking device 26 includes two locking pins 2 and 5, which lock in a locking slot 19 stationary with respect to the stator in order to lock rotor 17 relative to stator 16. Locking slot 19 may be provided, for example, in a sealing cover threaded to stator 16.

Basically, the phase angle of the camshaft relative to the crankshaft is shifted, for example, in the advance direction, by pressurizing working chambers 20 and 22 with pressure medium, thereby increasing their volume, while at the same time displacing the pressure medium from working chambers 21 and 23, thereby decreasing their volume. In the figures, the advance stop position is denoted by F, and the retard stop position is denoted by S. In the context of the present invention, the working chambers 20, 21, 22 and 23 whose volume is increased in groups during this adjusting movement are referred to as working chambers 20, 21, 22 and 23 of one direction of action, while the working chambers 20, 21, 22 and 23 whose volume is at the same time decreased are referred to as working chambers 20, 21, 22 and 23 of the opposite direction of action. The change in the volume of working chambers 20, 21, 22 and 23 then causes rotor 17 to be rotated with its vanes 11 and 12 relative to stator 16.

FIG. 3 shows the camshaft phaser during normal operation. In the upper, developed view of stator 16, the volume of working chambers 21 and 23 is increased by pressurizing them with pressure medium via the B-port of multi-way control valve 7, while the volume of working chambers 20 and 22 is at the same decreased by the return flow of the pressure medium via the A-port of multi-way control valve 7. This change in volume causes rotor 17 to rotate relative to stator 16, which results in a movement of vanes 11 and 12 in the direction of the arrow toward the left in the developed view. To enable rotor 17 to move relative to stator 16, central-position locking device 26 is first released by pressurizing locking slot 19 with pressure medium via pressure medium conduit 18 from the C-port of multi-way control valve 7 by means of pump P. The pressurization of locking slot 19 with pressure medium causes locking pins 2 and 5 to be urged out of locking slot 19, so that rotor 17 can then freely rotate relative to stator 16. To this extent, the camshaft phaser is similar to the prior art.

In the approach of the present invention, locking pins 2 and 5 each have a flow-through pressure medium conduit 13 and 14 and blocking portions 31 and 32 provided therein, respectively. Locking pins 2 and 5 are spring-loaded toward a first position in which they engage in locking slot 19, as can be seen by locking pin 2 in FIG. 1. Pressure medium conduit 14 is formed on locking pin 2 in such a way that it connects pressure medium conduit 27 to pressure medium conduit 8 when locking pin 2 is in the first position. Pressure medium conduit 8 is fluidically connected to pressure medium conduit 1, which opens into working chamber 20. Pressure medium conduit 27 is fluidically connected to pressure medium conduit 3, which opens into working chamber 21, and to pressure medium conduit 6, which opens into working chamber 23. Further provided is another pressure medium conduit 28, which connects pressure medium conduit 27 to the B-port of multi-way control valve 7. Check valve 9 is deliberately oriented in such a way that it allows flow of pressure medium into working chamber 20, but prevents reverse flow of pressure medium out of working chamber 20 through pressure medium conduit 8. Further, pressure medium conduit 8 is fluidically connected to pressure medium conduit 30, which in turn is fluidically connected to the A-port of multi-way control valve 7. In this position, rotor 17 is not locked after the internal combustion engine is stopped. This may occur, for example, when the internal combustion engine stalls. Locking pin 5 does not engage in locking slot 19 and has been moved into a second position against the spring force, and blocking portion 32 separates pressure medium conduit 15 and pressure medium conduit 29 from each other. Moreover, the pressure medium conduits provided in multi-way control valve 7 for the A- and B-ports are short-circuited, so that the pressure medium may flow from the A-port to the B-port in multi-way control valve 7 without having to flow through the check valve in the supply conduit to pressure medium pump P.

During the starting phase of the internal combustion engine, alternating torques act on the camshaft, and thus also on rotor 17. As a result of the torques acting on rotor 17 in the direction of the arrow in FIG. 1, the pressure medium is displaced from working chambers 21 and 23 through pressure medium conduits 3 and 6. The pressure medium in pressure medium conduit 3 then flows through pressure medium conduit 27 and flow-through pressure medium conduit 14 of the locking pin into pressure medium conduit 8 and finally through check valve 9 into and pressure medium conduit 1 into working chamber 20. Thus, working chambers 20 and 21 are, in effect, short-circuited via locking pin 2. At the same time, the pressure medium cannot flow back the same way because check valve 9 blocks pressure medium conduit 8 in the opposite direction. Concurrently, the pressure medium from working chamber 23 is passed via pressure medium conduit 6 into pressure medium conduit 28 toward the B-port of multi-way control valve 7. Because the B- and A-ports are short-circuited when multi-way control valve 7 is in the first switching position, the pressure medium can then flow via the A-port back into pressure medium conduit 30, and from there via pressure medium conduit 4 into working chamber 22. Thus, working chambers 22 and 23 are short-circuited via multi-way control valve 7, so that the pressure medium present in working chamber 23 cannot hinder the rotation of rotor 17. The described position of locking pins 2 and 5 allows rotor 17 to rotate in the direction of the arrow, but blocks it from rotating in the opposite direction. In the presence of torques acting in the opposite direction, rotor 17 supports itself via the pressure medium against check valve 9, since check valve 9 constitutes a kind of freewheel device due to its position and orientation. Because of this, rotor 17 is automatically rotated toward the central locking position in a pulsating manner utilizing the alternating camshaft torques in one direction only until locking pin 5 is urged by the spring force from the second position into the first position and engaged in locking slot 19.

In FIG. 2, rotor 17 and locking pins 2 and 5 are shown in a position where rotor 17 is locked into the central locking position from the direction of the advance stop position. In this case, the pressure medium is displaced from working chambers 20 and 22 into pressure medium conduits 1 and 4 in response to torques acting on rotor 17 in the direction of the arrow. The pressure medium in pressure medium conduit 1 is then fed via pressure medium conduit 30 into the A-port of multi-way control valve 7, passed further through the short-circuit and via the B-port back into pressure medium conduit 28 and pressure medium conduit 3 into working chamber 21. The pressure medium in pressure medium conduit 4 is then fed via pressure medium conduit 30, pressure medium conduit 13 in locking pin 5 and into pressure medium conduit 29. Because of the orientation of check valve 10, the pressure medium in pressure medium conduit 29 can flow into pressure medium conduit 27, from which it can flow via pressure medium conduits 3 and 6 into working chambers 21 and 23.

Pressure medium conduits 1, 3, 4 and 6 leading to working chambers 20, 21, 22 and 23 each open into partial ring-shaped or ring-shaped pressure medium conduits 27 and 30, which are fluidically connected to the A- or B-port of multi-way control valve 7, either indirectly via pressure medium conduit 28 or, in the case of pressure medium conduit 27, directly. Further, pressure medium conduit 27 is connected directly to pressure medium conduit 14 in locking pin 2, and pressure medium conduit 30 is connected indirectly via pressure medium conduit 15 to pressure medium conduit 13 of locking pin 5. Moreover, pressure medium conduits 8 and 29 are connected by check valves 9 and 10 disposed therein to pressure medium conduits 27 and 30. Thus, pressure medium conduits 27 and 30 constitute collecting conduits into which is fed the pressure medium from the two working chambers 20 and 22 of decreasing volume, and from which the pressure medium is then removed and fed into working chambers 21 and 23 of increasing volume. It is important that the inflow of pressure medium be equal to the outflow of pressure medium in terms of volume so as not to hinder rotation of rotor 17.

In FIG. 3, the camshaft phaser is shown during normal operation during adjustment of rotor 17 relative to stator 16. Multi-way control valve 7 has been moved from the first into a second switching position, in which the pressure medium is fed via pressure medium pump P to the C-port and the B-port, while it can flow back into pressure medium reservoir T through the A-port. By supplying pressurized pressure medium to the C-port, the pressure medium is fed via pressure medium conduit 18 into locking slot 19, and locking pins 2 and 5 are moved against the spring force from the first position to the second position, in which they fluidically connect working chambers 20 and 22, respectively 21 and 23, of the same direction of action via flow-through pressure medium conduits 13 and 14. At the same time, the A-port and the B-port are no longer short-circuited when multi-way control valve 7 is in the second position, so that the pressure medium can no longer be transferred between working chambers 20, 21, 22 and 23 of different directions of action. The pressure medium is then fed from the B-port via pressure medium conduits 28 and 6 into working chamber 23, and via pressure medium conduits 28, 27 and 3 into working chamber 21, so that the volume of working chambers 21 and 23 is increased. Concurrently, the pressure medium from working chambers 20 and 22 flows via pressure medium conduits 1, 4 and 30 and via the A-port of multi-way control valve 7 back into pressure medium reservoir T, so that the volume of working chambers 20 and 22 is decreased. As a result of the change in the volume of working chambers 20, 21, 22 and 23, rotor 17 is rotated with its vanes 11 and 12 relative to stator 16 in the direction of the arrow toward the left in the upper, developed view.

LIST OF REFERENCE NUMERALS

1 pressure medium conduit
2 locking pin
3 pressure medium conduit
4 pressure medium conduit
5 locking pin
6 pressure medium conduit
7 multi-way control valve
8 pressure medium conduit
9 check valve
10 check valve
11 vane
12 vane
13 pressure medium conduit
14 pressure medium conduit
15 pressure medium conduit
16 stator
17 rotor
18 pressure medium conduit
19 locking slot
20 working chamber
21 working chamber
22 working chamber
23 working chamber
24 pressure chamber
25 pressure chamber
26 central-position locking device
27 pressure medium conduit
28 pressure medium conduit
29 pressure medium conduit
30 pressure medium conduit
31 blocking portion
32 blocking portion

What is claimed is:

1. A camshaft phaser comprising:

a vane-type phaser having a stator connectable to a crankshaft of an internal combustion engine, and a rotor rotatably mounted in the stator and connectable to a camshaft, the stator being provided with a plurality of lobes dividing an annular space between the stator and the rotor into a plurality of pressure chambers, the rotor having a plurality of radially outwardly extending vanes dividing the pressure chambers into two groups of working chambers of different directions of action, said working chambers each being capable of being pressurized with a pressure medium flowing in and out in a pressure medium circuit, and a central-position locking device for locking the rotor in a central locking position relative to the stator, the central-position locking device having at least two spring-loaded locking pins lockable in a locking slot stationary with respect to the stator and which, during a rotation of the rotor from either of an advance stop position or a retard stop position toward the central locking position, lock in the locking slot from different directions, at a first locking pin of the at least two spring-loaded locking pins being provided with a blocking portion and a flow-through pressure medium conduit, by which a fluid connection between two of the working chambers of different directions of action can be established or blocked in the different positions of the first locking pin, the working chambers of the different directions of actions being capable of being short-circuited by a switching device, and at least one pressure medium conduit fluidically connectable to the pressure medium circuit by the flow-through pressure medium conduit of the first locking pin having a check valve therein allowing the pressure medium to flow into one of the working chambers whose volume is increased during a rotation of the rotor from either of the advance or retard stop positions toward the central locking position, while at the same time preventing backflow from the same working chamber.

2. The camshaft phaser as recited in claim 1 wherein the at least one flow-through pressure medium conduit is provided in each of the two spring-loaded locking pins, and two of the check valves are provided in different pressure medium conduits connectable to the pressure medium circuit via the flow-through pressure medium conduits of the locking pins, the check valves being oriented to allow the pressure medium to flow into working chambers of different directions of action and to prevent backflow from the working chambers of different directions of action.

3. The camshaft phaser as recited in claim 1 wherein in a first position, the first locking pin allows the pressure medium to flow to the check valve via the flow-through pressure medium conduit and, in a second position, the first locking pin prevents such flow via blocking portions, and the first locking pin being spring-loaded in a direction toward the first position.

4. The camshaft phaser as recited in claim 1 wherein the switching device for short-circuiting the working chambers takes the form of a multi-way control valve controlling the inflow and outflow of the pressure medium from or into a pressure medium reservoir.

5. The camshaft phaser as recited in claim 1 wherein the rotor has at least one partial ring-shaped or ring-shaped pressure medium conduit provided therein into which open at least some of the pressure medium conduits leading to the working chambers.

* * * * *